US010421302B2

(12) United States Patent
Tsugaru

(10) Patent No.: US 10,421,302 B2
(45) Date of Patent: Sep. 24, 2019

(54) COVER OPENING AND CLOSING MECHANISM, AND PRINTER

(71) Applicants: CITIZEN WATCH CO., LTD., Nishitokyo-shi, Tokyo (JP); CITIZEN SYSTEMS JAPAN CO., LTD., Nishitokyo-shi, Tokyo (JP)

(72) Inventor: Hiroyuki Tsugaru, Tokorozawa (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 15/908,527

(22) Filed: Feb. 28, 2018

(65) Prior Publication Data

US 2018/0250966 A1 Sep. 6, 2018

(30) Foreign Application Priority Data

Mar. 2, 2017 (JP) ..... 2017-039552

(51) Int. Cl.

| | |
|---|---|
| ***B41J 29/13*** | (2006.01) |
| ***B41J 2/345*** | (2006.01) |
| ***B41J 2/325*** | (2006.01) |
| ***B41J 29/02*** | (2006.01) |

(52) U.S. Cl.

CPC ..... *B41J 29/13* (2013.01); *B41J 2/325* (2013.01); *B41J 2/345* (2013.01); *B41J 29/02* (2013.01); *B41J 2202/31* (2013.01)

(58) Field of Classification Search

CPC ... B41J 29/13; B41J 29/02; B41J 2/325; B41J 2/345; B41J 2202/31; B41J 29/00; B41J 29/023; B41J 29/026

See application file for complete search history.

(56) References Cited

FOREIGN PATENT DOCUMENTS

| | | | |
|---|---|---|---|
| JP | 2007-329241 | * | 12/2007 |
| JP | 2007329241 A | | 12/2007 |
| JP | 4668848 B2 | | 4/2011 |

* cited by examiner

*Primary Examiner* — Kristal Feggins
(74) *Attorney, Agent, or Firm* — Myers Wolin, LLC

(57) ABSTRACT

A cover is coupled to a main body casing in manner enabling rotation of the cover. A pop-up mechanism is provided that when locking by a locking mechanism that fixes the cover at a closed position in a releasable manner is released, rotates the cover from the closed position to an open position by a biasing of first contact members in a direction so that the first contact members push second contact members that are respectively disposed at both ends of the cover, the first contact members being connected to each other and respectively disposed at both ends of the main body casing. Thus, the second contact members are pushed while a positional relationship of the first contact members is maintained to be constant.

7 Claims, 11 Drawing Sheets

COVER OPENING AND CLOSING MECHANISM, AND PRINTER

CROSS REFERENCE TO RELATED APPLICATIONS

This application is based upon and claims the benefit of priority of the prior Japanese Patent Application No. 2017-039552, filed on Mar. 2, 2017, the entire contents of which are incorporated herein by reference.

BACKGROUND OF THE INVENTION

1. Field of the Invention

The present invention relates to a printer and a cover opening and closing mechanism related to opening and closing a cover coupled to a main body casing.

2. Description of the Related Art

A conventional printer has, for example, a housing unit that houses a recording medium, and a recording unit that performs a recording operation with respect to the recording medium. The housing unit and the recording unit are housed in a clamshell-type casing constituted by a substantially box-shaped main body casing having an opening, and a cover coupled to the main body casing in a manner enabling the cover to rotate between a closed position closing the opening provided in the main body casing and an open position opening the opening.

Among such printers are printers that have a locking mechanism that fixes the cover at the closed position in a releasable manner, a pop-up mechanism that pushes open the cover when the cover is released from a fixed state established by a locking mechanism, etc. A related art, for example, conventionally includes a pop-up mechanism that is biased in a direction to individually push open both sides of a cover, the sides of the cover being in a width direction (for example, refer to Japanese Patent No. 4668848).

SUMMARY OF THE INVENTION

According to an embodiment of the present invention, a cover opening and closing mechanism includes a main body casing having an opening; a cover coupled to the main body casing in a manner enabling the cover to rotate between a closed position closing the opening of the main body casing and an open position opening the opening; a locking mechanism that fixes the cover at the closed position in a releasable manner; and a pop-up mechanism that rotates the cover from the closed position toward the open position when locking by the locking mechanism is released. The pop-up mechanism includes: first contact members that are connected to each other and are respectively disposed at both ends of one of the main body casing and the cover, the both ends in a direction parallel to a rotation axis of the cover; second contact members respectively disposed at another of the main body casing and the cover not disposed with the first contact members, the second contact members disposed at positions that interfere on a trace of movement of the first contact members accompanying rotation of the cover, the second contact members abutting the first contact members when the cover is positioned within a predetermined range from the closed position; and a biasing member that bias the first contact members in a direction so that the first contact members push the second contact members.

DETAILED DESCRIPTION OF THE INVENTION

First, problems related to the conventional technology described in Japanese Patent No. 4668848 will be discussed. The conventional technology has a problem in that the pop-up mechanism acts on both sides of the cover in a width direction independently of each other and therefore, in an instance where a left end or a right end, etc. is biasedly pushed when the cover is being closed, one of the ends may not lock, whereby a problem arises in that the cover may not close completely.

In the printer, further problems arise in that when a recording operation is performed in a state where one of the ends is not locked and the cover is not completely closed, the recording medium cannot be stably conveyed, whereby jamming occurs, and pressure applied to the recording medium at the time of the recording operation is biased in the width direction, reducing recording quality.

In the printer having the pop-up mechanism, a force that pushes open the cover is applied and therefore, when one of the ends is not locked and the cover continues to be in a state of not being closed completely, a problem arises in that this state causes deformation of the cover. Such deformation of the cover tends to significantly occur due to instances where to reduce the weight and/or the cost of the printer, the casing is formed using a resin material instead of a metal material. Thus, a problem arises in that weight and cost reductions of the printer are hindered.

The printer having the pop-up mechanism has a further problem in that in instances where the cover is formed using a resin material and the left end or the right end of the cover is biasedly pushed when closing the cover, the cover is easily deformed by the force applied by the pop-up mechanism to push open the cover.

Embodiments of a cover opening and closing mechanism, and a printer according to the present invention will be described in detail with reference to the accompanying drawings.

Figure 1A:
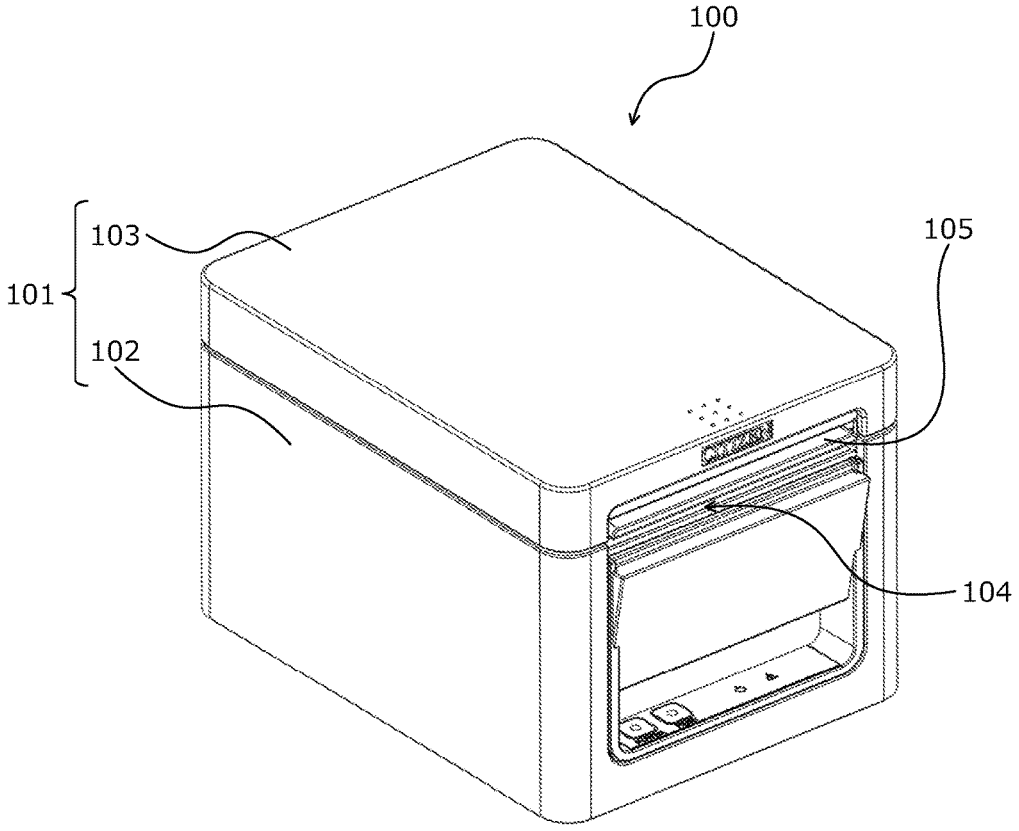
FIG. 1A is a diagram (part 1) depicting an exterior of a printer having a cover opening and closing mechanism of an embodiment according to the present invention.
Figure 1B:
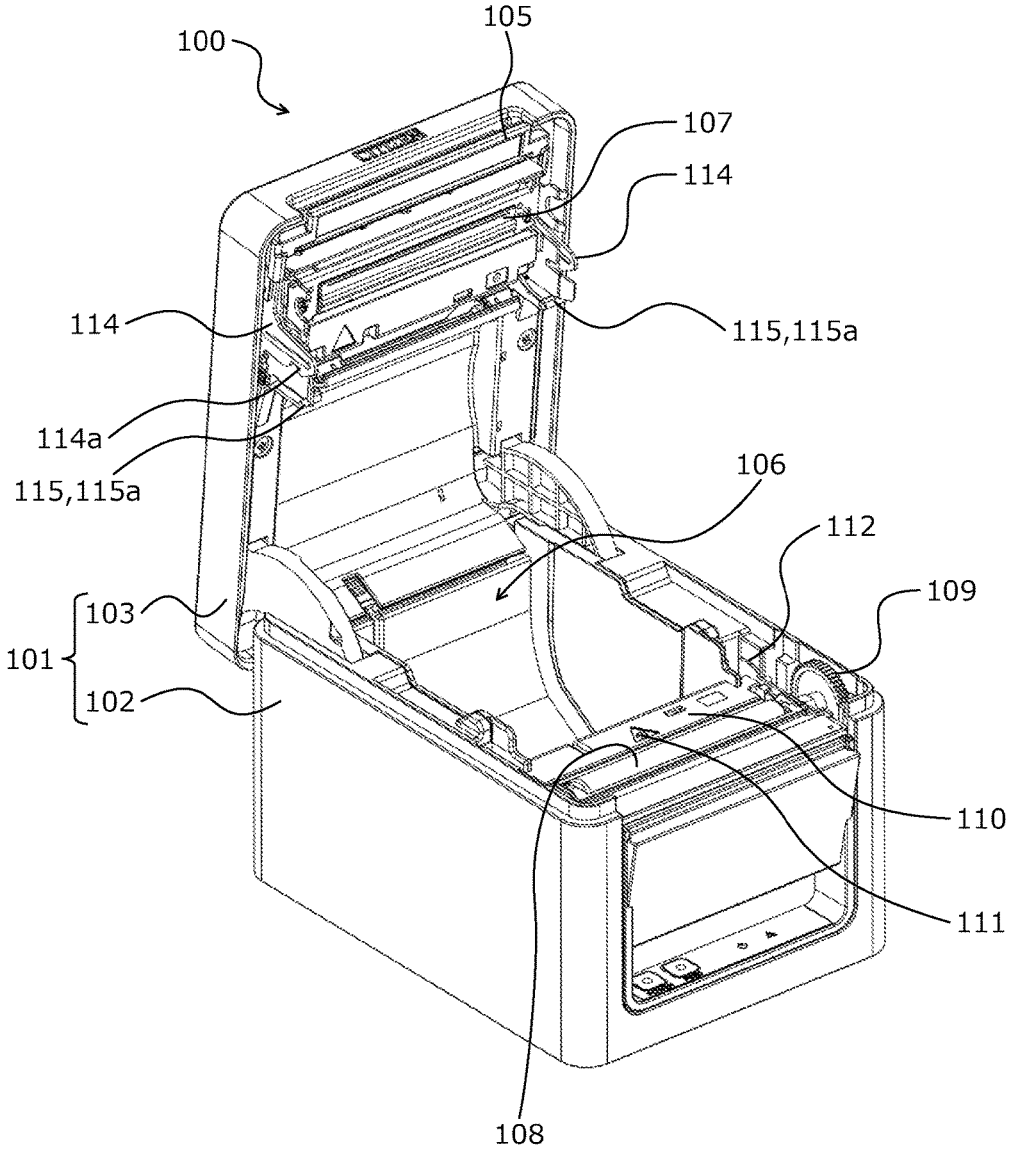
FIG. 1B is a diagram (part 2) depicting the exterior of the printer having the cover opening and closing mechanism of the embodiment according to the present invention.
Figure 1C:
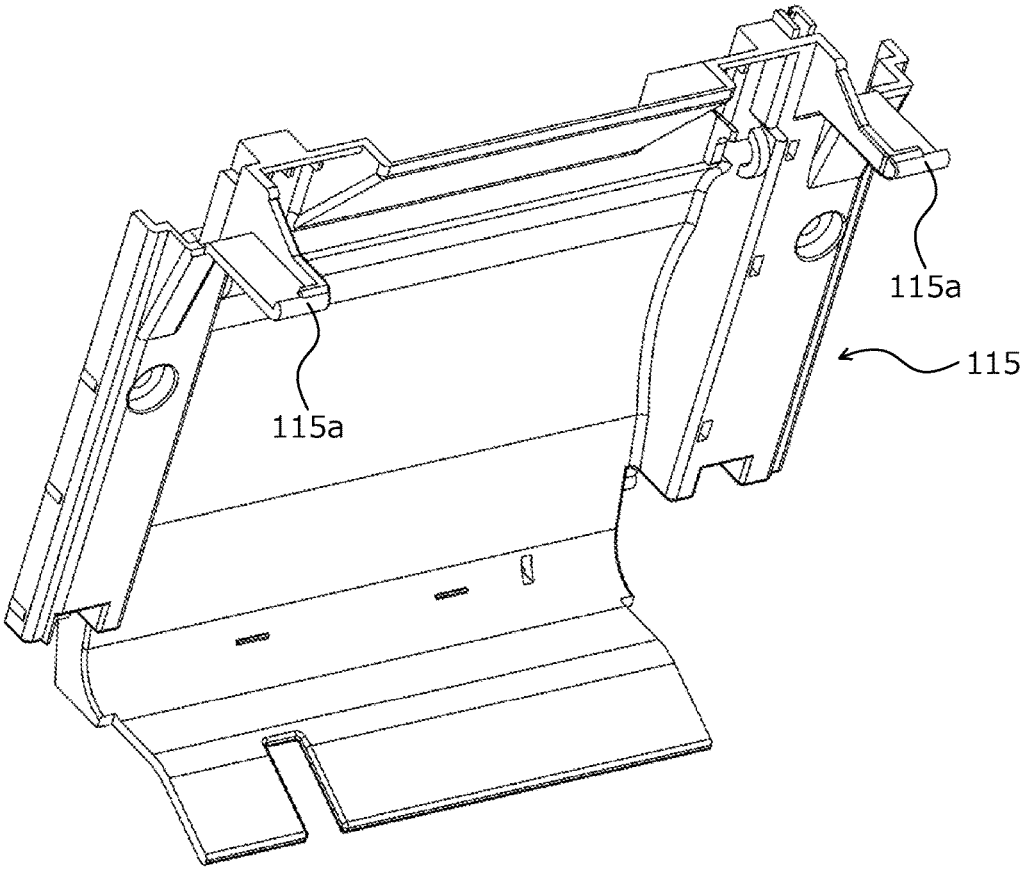
FIG. 1C is a diagram (part 1) depicting a part of the cover opening and closing mechanism of the embodiment according to the present invention.

An exterior of the printer having the cover opening and closing mechanism of an embodiment of the present invention will be described. FIGS. 1A and 1B are diagrams depicting the exterior of the printer having the cover opening and closing mechanism of the embodiment according to the present invention. FIG. 1C is a diagram depicting a part of the cover opening and closing mechanism of the embodiment according to the present invention.

In FIG. 1A and FIG. 1B, a printer 100 of the embodiment according to the present invention includes a casing 101. The casing 101 is constituted by a main body casing 102 and a cover 103. The main body casing 102 has a box-like shape with an opening (refer to FIG. 1B) opened toward one side (upward).

On a front side of the casing 101, a paper ejection outlet 104 that ejects a recording medium that has been subjected to recording is disposed between the main body casing 102 and the cover 103. Further, on the front side of the casing 101, an operation lever 105 is disposed. The operation lever 105, for example, is grasped by a user when opening the cover 103.

At a rear side of the printer 100, the cover 103 is coupled to the main body casing 102 in a manner enabling the cover 103 to rotate relative to the main body casing 102, the cover 103 rotating between a closed position closing the opening provided in the main body casing 102 and an open position opening the opening. FIG. 1A depicts a state where the cover 103 is positioned at the closed position.

The printer 100, when used, is installed in a state where the opening faces upward, i.e., a state where the main body casing 102 is positioned lower than the cover 103. The cover 103 is rotated with respect to the main body casing 102 and positioned at the open position, whereby an inside of the casing 101 can be open to the outside.

FIG. 1B depicts a state where the cover 103 is positioned at the open position (fully open position), opening the inside of the casing 101 to the outside. Inside the casing 101, a printer main body is disposed. The printer main body includes a housing unit 106 that houses an unrecorded recording medium that is subject to recording. The housing unit 106 houses the long recording medium wound in a roll.

The printer main body includes a recording unit. The recording unit performs a recording operation with respect to the recording medium and is provided in the casing 101, farther on the paper ejection outlet 104 side than the housing unit 106. The recording unit is constituted by a print head 107 disposed in the cover 103 and a platen 108 disposed in the main body casing 102. The print head 107 and the platen 108 face each other when the cover 103 is positioned at the closed position.

The print head 107, for example, performs a thermal recording operation. The print head 107 that performs the thermal recording operation, for example, includes plural heating elements arranged in a row along a width direction (direction orthogonal to a direction in which the recording medium is conveyed) of the printer 100. The printer 100 includes a control circuit that controls driving of components included in the printer 100. Under the control of the control circuit, the heating elements in a thermal head are selectively energized to selectively heat the heating elements and thereby, perform the recording operation.

The platen 108 has a substantially cylindrical shape having an axial direction parallel to the width direction of the printer 100. The platen 108 supports the recording medium from a rear surface side of the recording medium at the time of the recording operation when a pushing force is applied to the recording medium from a front surface (recording surface) side of the recording medium by the print head 107. The print head 107 is biased in a direction so as to abut the platen 108 when the cover 103 is positioned at the closed position.

Figure 2A:
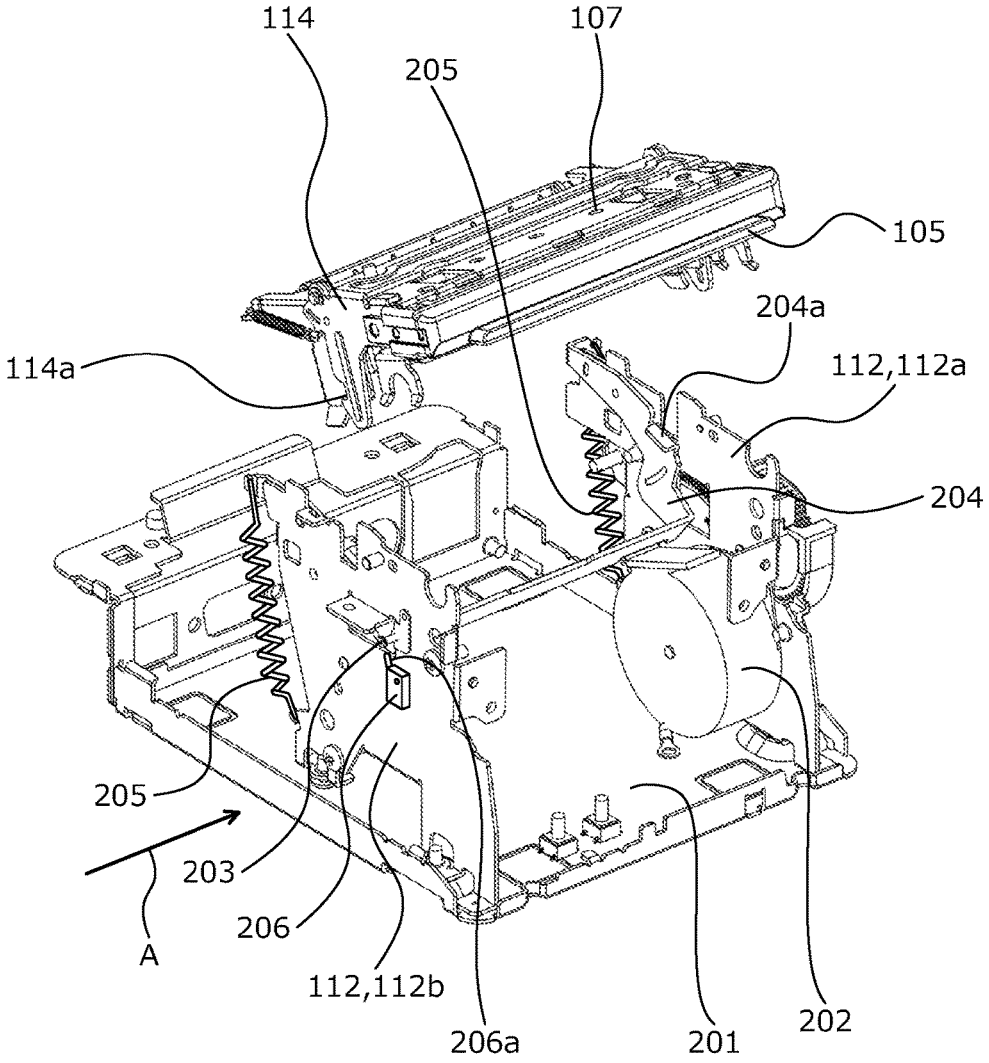
FIG. 2A is a diagram depicting the cover opening and closing mechanism.

A gear 109 is attached to an axial end of the platen 108, whereby the platen is coupled, through a gear train, to a motor (refer to 202 in FIG. 2A) attached to a side frame 112 (refer to 112*a* in FIG. 2A). The gear train is rotated by transmission of a driving force of the motor. The platen 108 rotates with the rotation of the gear 109 constituting the gear train. The platen 108 conveys the recording medium from the housing unit 106 side to the paper ejection outlet 104 side by rotating.

A conveyance guide 110 is disposed in the casing 101, farther on the housing unit 106 side than the platen 108. The conveyance guide 110 guides the position of the recording medium from the housing unit 106 to the paper ejection outlet 104. A recording medium detection sensor 111 is disposed in the conveyance guide 110. The recording medium detection sensor 111 can be implemented by, for example, a reflection-type photoelectric sensor having a light emitting element and a light receiving element.

In this case, the light emitting element emits light to the recording medium conveyed from the housing unit 106 to the paper ejection outlet 104, and is disposed so that light reflected from the recording medium is received by the light receiving element. The photoelectric sensor varies output according to changes in the amount of light received at the light receiving element. The printer 100 includes a control circuit that controls components included in the printer 100, and a signal output from the recording medium detection sensor 111 is input to the control circuit.

The side frames 112 (refer to 112*a*, 112*b* in FIG. 2A) that support the platen 108, the conveyance guide 110, etc. are disposed inside the casing 101. The side frames 112 are formed by processing a sheet metal member. The side frames 112 are disposed respectively at both ends inside the main body casing in a width direction of the recording medium. The side frames 112 are arranged facing each other along the width direction of the recording medium, and support both ends of the conveyance guide 110 in the width direction and the platen 108.

A lock lever 114 is disposed in the cover 103. The lock lever 114 is disposed at both ends of the cover 103 in the width direction, and protrudes from the cover 103 toward the main body casing 102. Each lock lever 114 includes a hook 114*a* disposed at an end toward the main body casing 102. The lock lever 114 is disposed to enable the lock lever 114 to pivot along a rotation plane of the cover 103, using the end toward the cover 103 as a fulcrum. For example, in case where the operation lever 105 that is disposed in the cover 103 is manipulated, the lock lever 114 pivots according to the manipulation.

Second contact members 115 are disposed in the cover 103. The second contact members 115 protrude from the cover 103 toward the main body casing 102 and are disposed at both ends of the cover 103 in the width direction, farther on the housing unit 106 side than the lock lever 114. A contact guide 115*a* is disposed at the second contact members 115, on a tip thereof that protrudes toward the main body casing 102. The contact guide 115*a* is formed using a resin material having a hardness lower than that of a metal material. The contact guide 115*a* is disposed so as to cover the tip of the second contact member 115, the tip protruding toward the main body casing 102.

The second contact members 115 disposed at the ends in the width direction are integrally formed by processing a sheet metal member and as depicted in FIG. 1C, are connected to each other. Formation of the second contact members 115 using a sheet metal member, i.e., a metal material, enables rigidity and strength of the second contact members 115 to be ensured. The second contact members 115 constitute a part of the cover opening and closing mechanism according to the present invention.

(Cover Opening and Closing Mechanism)

Figure 2B:
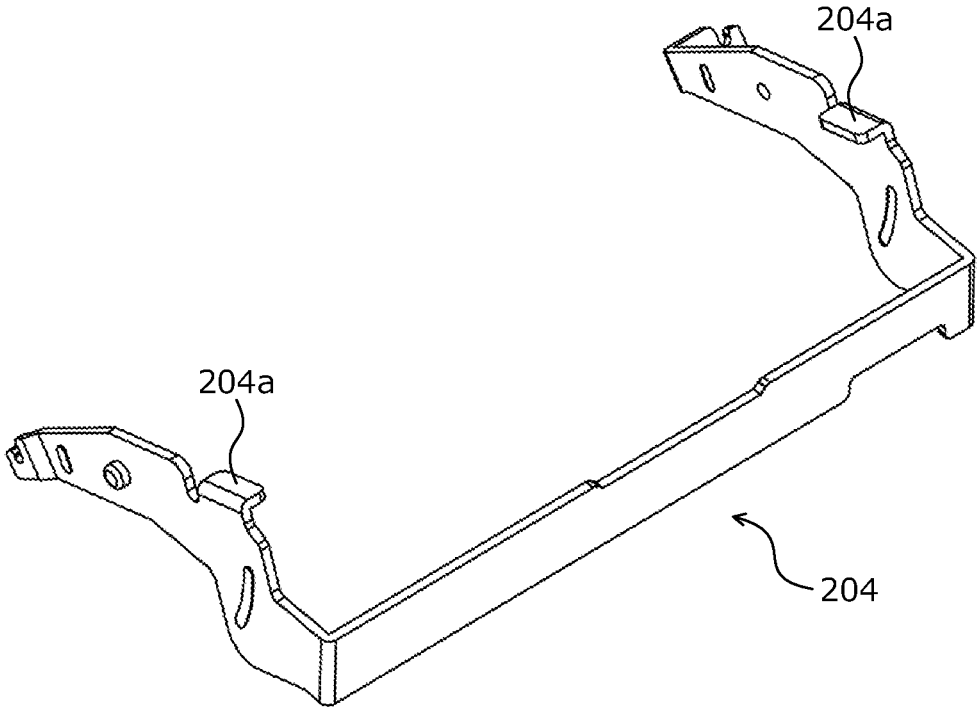
FIG. 2B is a diagram (part 2) depicting a part of the cover opening and closing mechanism.

The cover opening and closing mechanism will be described. FIG. 2A is a diagram depicting the cover opening and closing mechanism. FIG. 2B is a diagram depicting a part of the cover opening and closing mechanism. In FIG. 2A, the side frames 112 (112*a*, 112*b*) are fixed to a bottom frame 201 that is fixed to a bottom of the main body casing 102.

Of the side frames 112*a*, 112*b* disposed in the main body casing 102, at both ends thereof in the width direction, at one side frame 112*a*, a motor 202 that imparts a conveyance force on the platen 108 and a gear train that transmits a driving force of the motor 202 to the platen 108 are disposed. The side frame 112*a* is disposed on a same side as a reference surface that is a positioning reference of the recording medium in the housing unit 106.

An engaging unit 203 is disposed at each of the side frames 112*a*, 112*b* and protrudes toward the main body casing 102 from surfaces of the side frames 112*a*, 112*b* facing an inner surface of the main body casing 102. The engaging units 203 engage with the hooks 114*a* and thereby, fix the cover 103 at the closed position in a releasable state, i.e., locks the cover 103 at the closed position.

The engaging unit 203 and the hook 114*a* are engaged only in a state where the cover 103 is positioned at the closed position and, for example, are not engaged in a state where the lock lever 114 is pivoted in a direction separating the hook 114*a* from the engaging unit 203 by a manipulation of the operation lever 105 disposed at the cover 103. In the present embodiment, a locking mechanism according to the present invention is implemented by the lock lever 114 and the engaging unit 203.

Between the side frames 112*a*, 112*b* disposed inside the main body casing 102, a first contact member (pop-up member) 204 is disposed at both ends of the main body casing 102 in the width direction. The first contact member 204 is disposed between the side frames 112 (112*a*, 112*b*), at both ends in a direction parallel to a rotation axis of the cover 103 (width direction). The first contact members 204 are disposed, enabling the first contact members 204 to rotate using coupling positions with the side frames 112 as a fulcrum.

The first contact members 204 disposed at both ends in the width direction are integrally formed by processing a sheet metal member and as depicted in FIG. 2B, are connected to each other. Formation of the first contact members 204 using a sheet metal member, i.e., a metal material, enables rigidity and strength of the first contact members 204 to be ensured.

The first contact members 204 each includes a first contact part 204*a* disposed at a position interfering with the contact guide 115*a* on a trace of movement of the contact guide 115*a* that is disposed at the second contact members 115 that are disposed at both ends in the width direction. When the cover 103 is positioned within a predetermined range from the closed position, the first contact part 204*a* abuts the contact guide 115*a* disposed at the second contact member 115.

The first contact part 204*a* abuts the contact guide 115*a*, whereby the first contact member 204 is pushed by the second contact member 115 and rotates in a direction away from the cover 103. The contact guide 115*a* is formed using a resin material having a hardness lower than that of a metal material and therefore, even when the first contact members 204 and the second contact members 115 are formed using a metal material to ensure rigidity and strength, wear and damage of the first contact members 204 and the second contact members 115 caused by the first contact members 204 and the second contact members 115 abutting each other can be suppressed.

The first contact members 204 are biased by a biasing member 205, in a direction so that the first contact members 204 push the second contact members 115. The biasing member 205, for example, may be implemented by a tension spring, where one end of the tension spring is fixed to the first contact member 204 and the other end is fixed to the side frame 112. The biasing member 205 is not limited to a tension spring and can be implemented by a compression spring that biases the first contact member 204 in the direction that the first contact member 204 pushes the second contact member 115.

In the present embodiment, a pop-up mechanism according to the present invention is implemented by the first contact members 204, the second contact members 115, and the biasing member 205. Further, in the present embodiment, the cover opening and closing mechanism according to the present invention is implemented by the main body casing 102; the cover 103; the locking mechanism implemented by the lock lever 114 and the engaging unit 203; and the pop-up mechanism implemented by the first contact members 204, the second contact members 115 and the biasing member 205.

A lock sensor 206 is disposed on the side frames 112. Of the side frames 112*a*, 112*b* disposed at both ends in the width direction, the lock sensor 206 is preferably disposed at the side frame 112*b* different from the side frame 112*a* that supports the motor 202 and the gear train. The lock sensor 206, for example, can be implemented by a micro switch that opens or closes a switch (a contact with an electrical circuit) according to operation of an actuator, and outputs an ON signal or an OFF signal.

The lock sensor 206 includes a detector part 206*a* disposed at an interfering position on a trace of movement of the lock lever 114 in a state where the cover 103 is positioned at the closed position. The detector part 206*a* is positioned at a standby position when the hook 114*a* and the engaging unit 203 are not engaged. When the hook 114*a* and the engaging unit 203 are engaged, the detector part 206*a* is biased by the lock lever 114 and rotates from the standby position to a detection position.

The actuator included in the lock sensor 206 operates following the movement of the detector part 206*a* and opens or closes the switch. The lock sensor 206 outputs an ON signal or an OFF signal according to a state of the switch. The control circuit included in the printer 100 detects based on the signal output from the lock sensor 206, whether the cover 103 is locked at the closed position.

Even when the cover 103 is positioned at the closed position, the detector part 206*a* is positioned at the standby position in a state where the hook 114*a* and the engaging unit 203 are not engaged due to the operation lever 105 being grasped or the like. As a result, even when the cover 103 is positioned at the closed position, the control circuit detects that the cover 103 is not locked at the closed position in the state where the hook 114*a* and the engaging unit 203 are not engaged.

The control circuit can be implemented by a board on which is mounted, a microcomputer configured by a CPU, a memory, various types of interfaces, and the like. In addition to detection of a locking state of the cover 103, the control circuit performs energization control of the print head 107, driving control of the motor 202 that drives the platen 108, and the like. Further, the control circuit detects based on a signal output from the recording medium detection sensor 111, a presence or absence of the recording medium conveyed from the housing unit 106 to the paper ejection outlet 104.

(Operation of Locking Mechanism and Lock Sensor 206)

Figure 3:
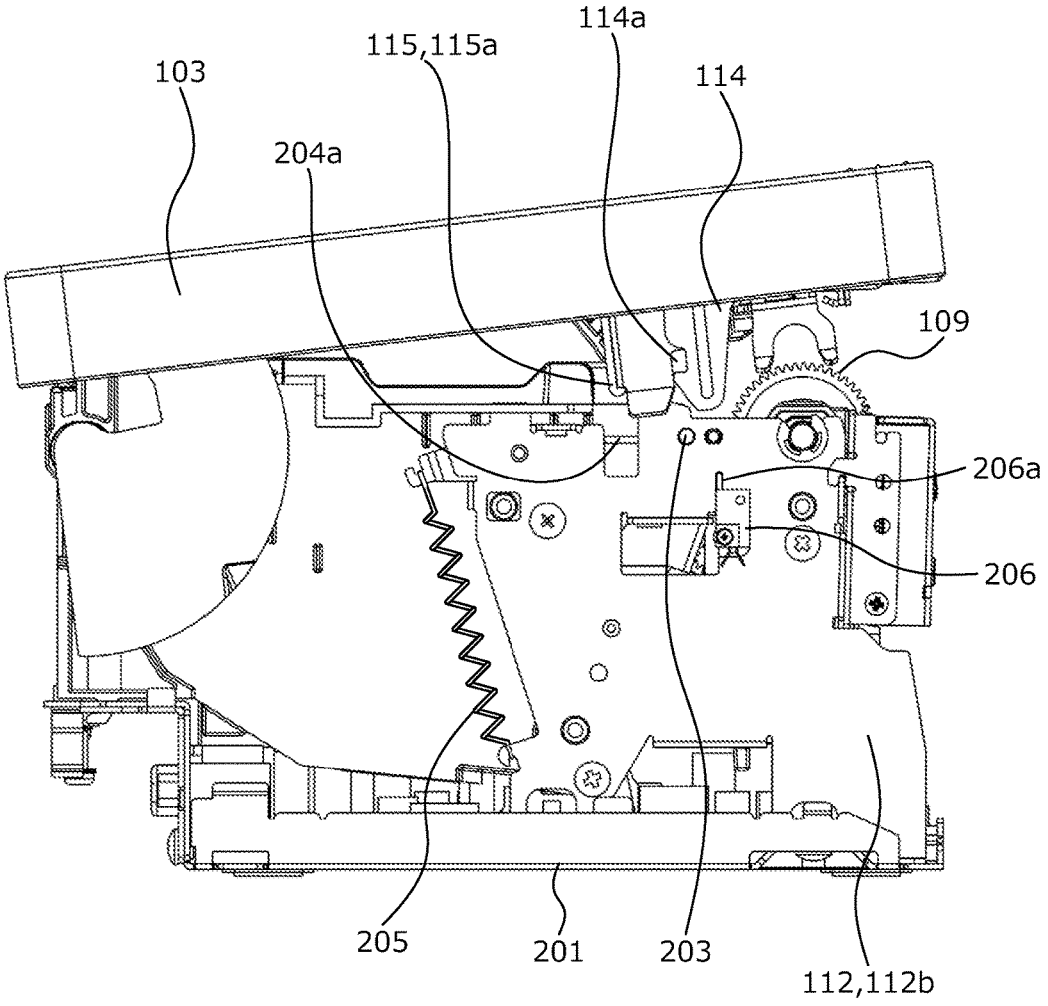
FIG. 3 is a diagram (part 1) depicting operation of a locking mechanism and a lock sensor.
Figure 4:
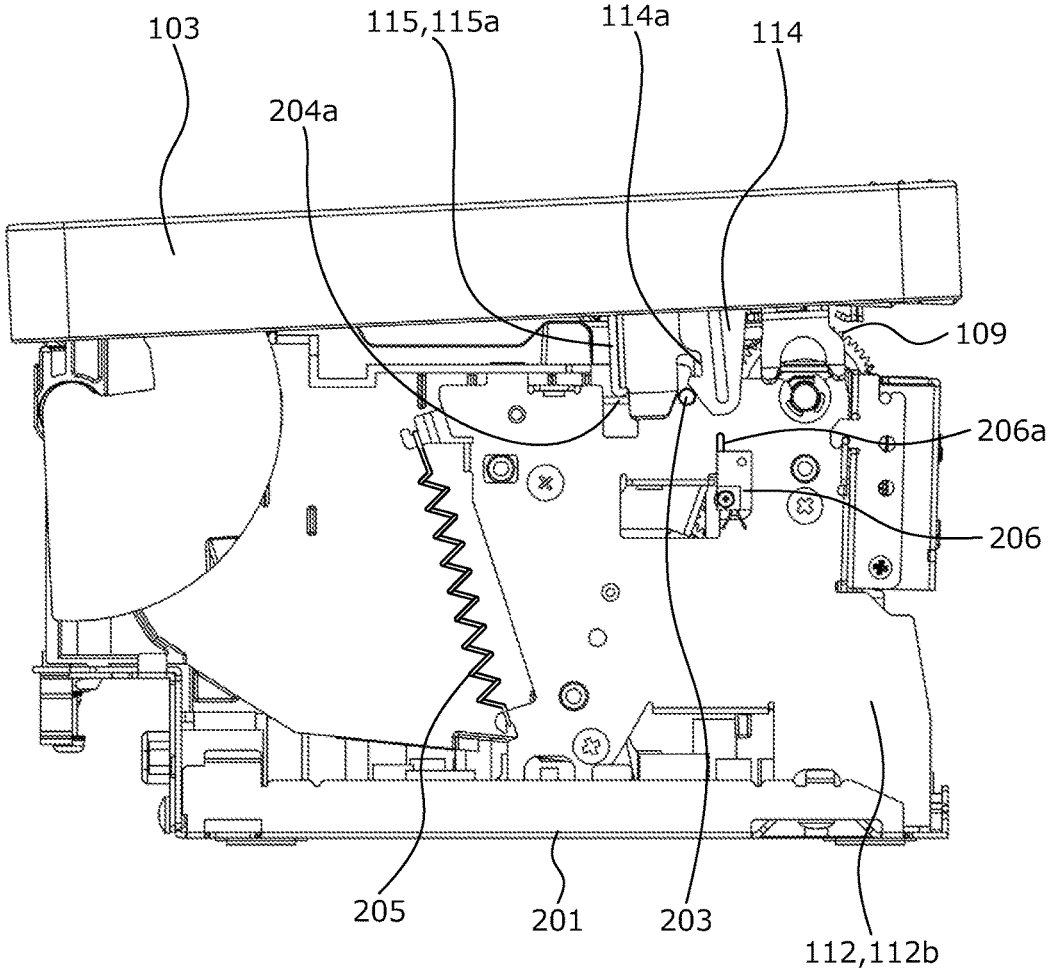
FIG. 4 is a diagram (part 2) depicting the operation of the locking mechanism and the lock sensor.
Figure 5:
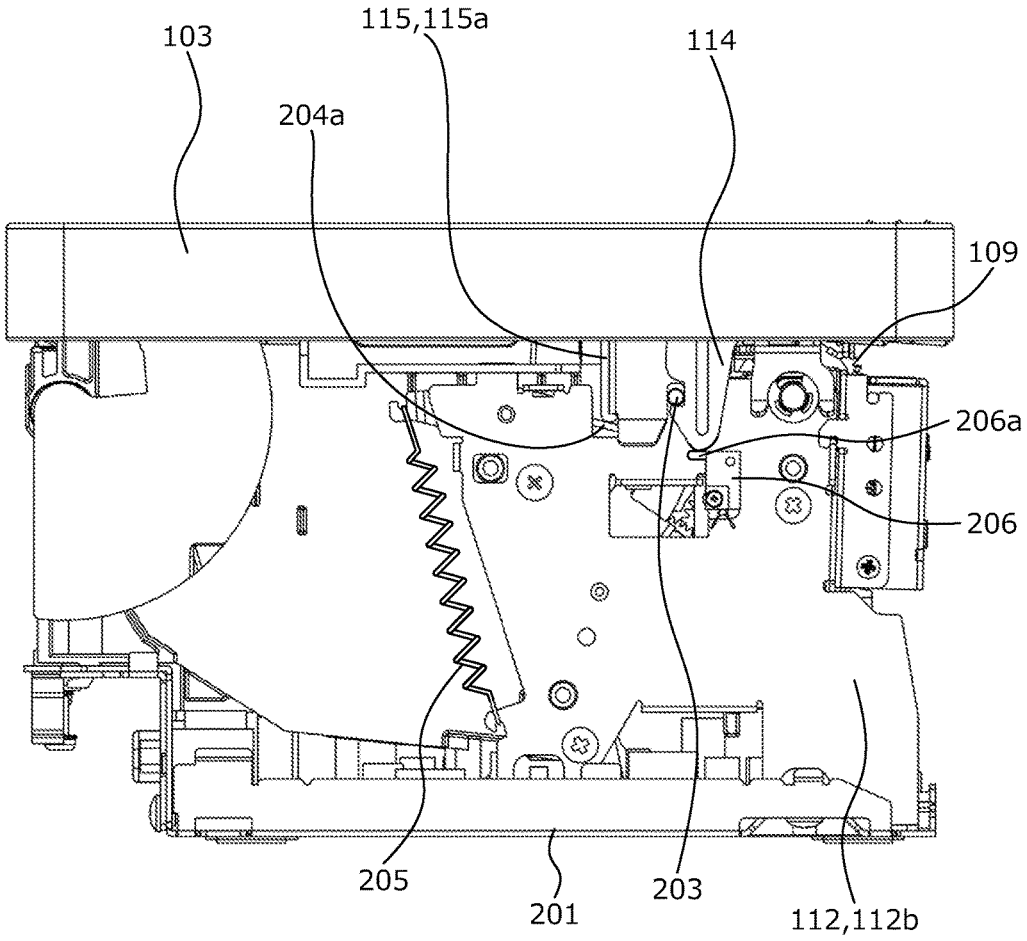
FIG. 5 is a diagram (part 3) depicting the operation of the locking mechanism and the lock sensor.

Operation of the locking mechanism and the lock sensor 206 will be described. FIGS. 3, 4, and FIG. 5 are diagrams depicting the operation of the locking mechanism and the lock sensor 206. FIG. 3 to FIG. 5 depict, as viewed from a direction indicated by arrow A in FIG. 2A, the printer 100 in a state where the main body casing 102 has been removed.

In a state where the cover 103 is positioned at a position opened more than the predetermined range from the closed position, the first contact member 204 and the second contact member 115 are separated from each other. Further, in the state where the cover 103 is positioned at a position opened more than the predetermined range from the closed position, as depicted in FIG. 3, the tip of the lock lever 114 is separated from the engaging unit 203.

When the cover 103 is positioned at the closed position from the state depicted in FIG. 3, the cover 103 rotates toward the closed position, whereby the first contact members 204 and the second contact members 115 abut each other as depicted in FIG. 4. When the first contact members 204 and the second contact members 115 start to abut each other, the tip of the lock lever 114 is separate from the engaging unit 203, as depicted in FIG. 4.

When the cover 103 further rotates toward the closed position from the position depicted in FIG. 4, the tips of the lock levers 114 abut the engaging units 203 from the cover 103 side. From this state, when the cover 103 further rotates toward the closed position, the tips of the lock levers 114 are pushed by the engaging units 203 and so as to avoid the engaging units 203, the lock levers 114 pivot along the rotation plane of the cover 103, using the end of the lock levers 114 toward the cover 103 as a fulcrum. As a result, a state can be avoided where the tips of the lock levers 114 and the engaging units 203 interfere with each other and the cover 103 cannot be closed.

When the cover 103 is positioned at the closed position, the lock levers 114, which pivot so as to avoid the engaging units 203, pivot in a direction so that the hooks 114*a* and the engaging units 203 engage, the lock levers 114 pivoting due to non-depicted biasing member. As a result, the hooks 114*a* and the engaging units 203 engage, and the cover 103 is locked at the closed position. The lock levers 114 that pivot so as to avoid the engaging units 203 can pivot in a direction engaging the engaging units 203, only in a state where the cover 103 is positioned at the closed position.

Due to engagement of the hooks 114*a* and the engaging units 203, the lock lever 114 abuts the detector part 206*a*, the detector part 206*a* rotates, and actuator operates. As a result, the control circuit detects that the cover 103 is locked at the closed position. Further, when the cover 103 has been detected to be locked at the closed position, the control circuit controls energization of the print head 107, controls driving of the motor 202, drives the platen 108, and the like, thereby performing a recording operation.

(Operation of Cover Opening and Closing Mechanism)

Figure 6:
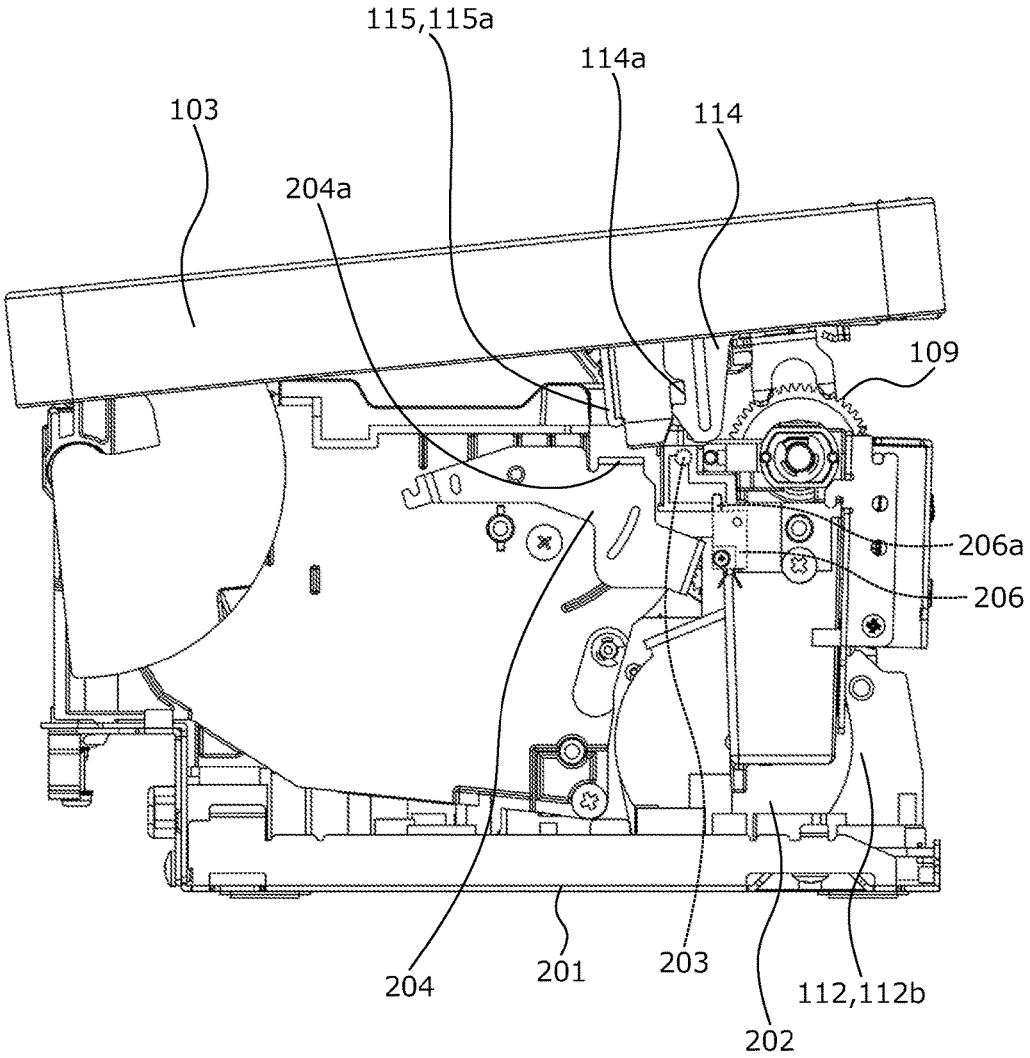
FIG. 6 is a diagram (part 1) depicting operation of the cover opening and closing mechanism.
Figure 7:
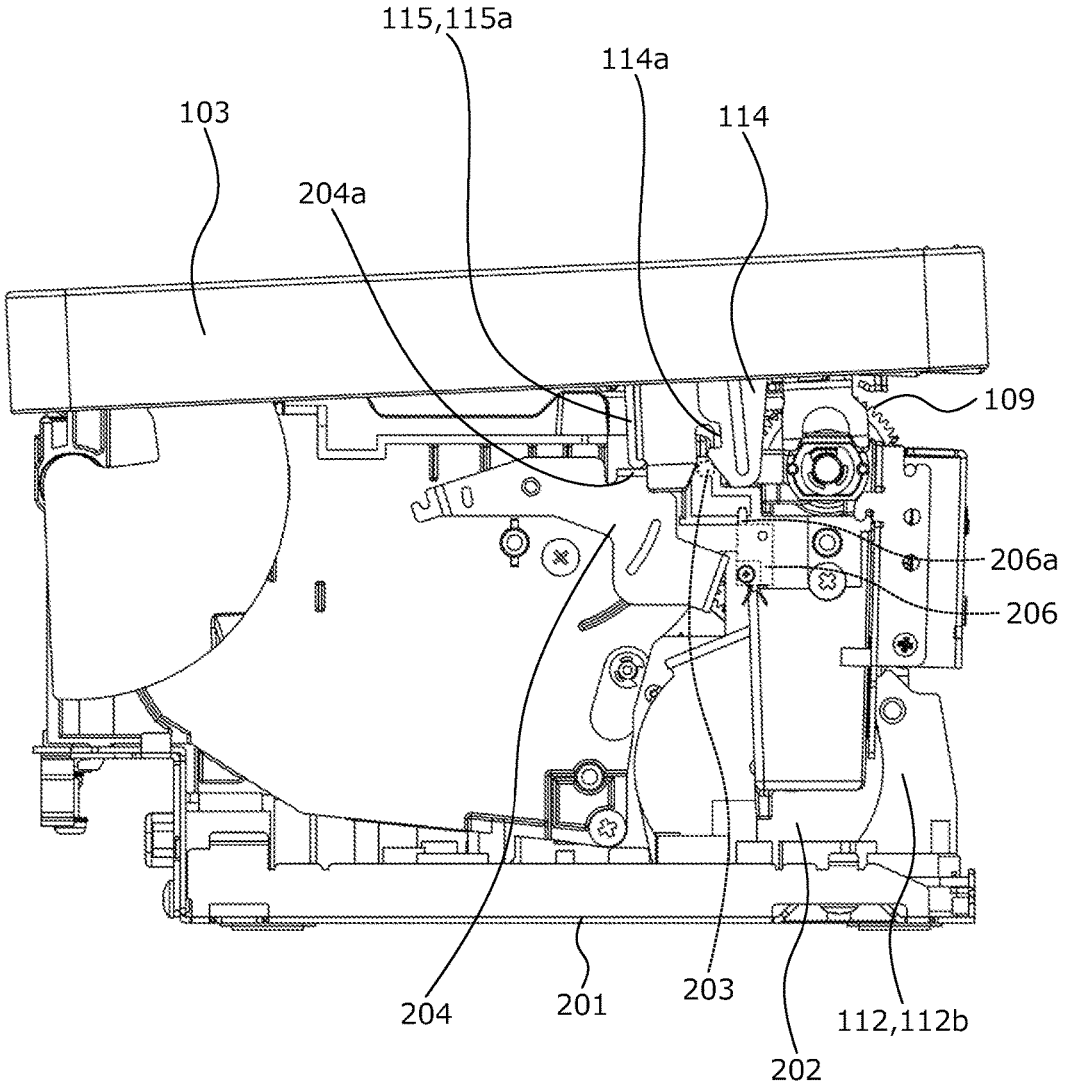
FIG. 7 is a diagram (part 2) depicting the operation of the cover opening and closing mechanism.
Figure 8:
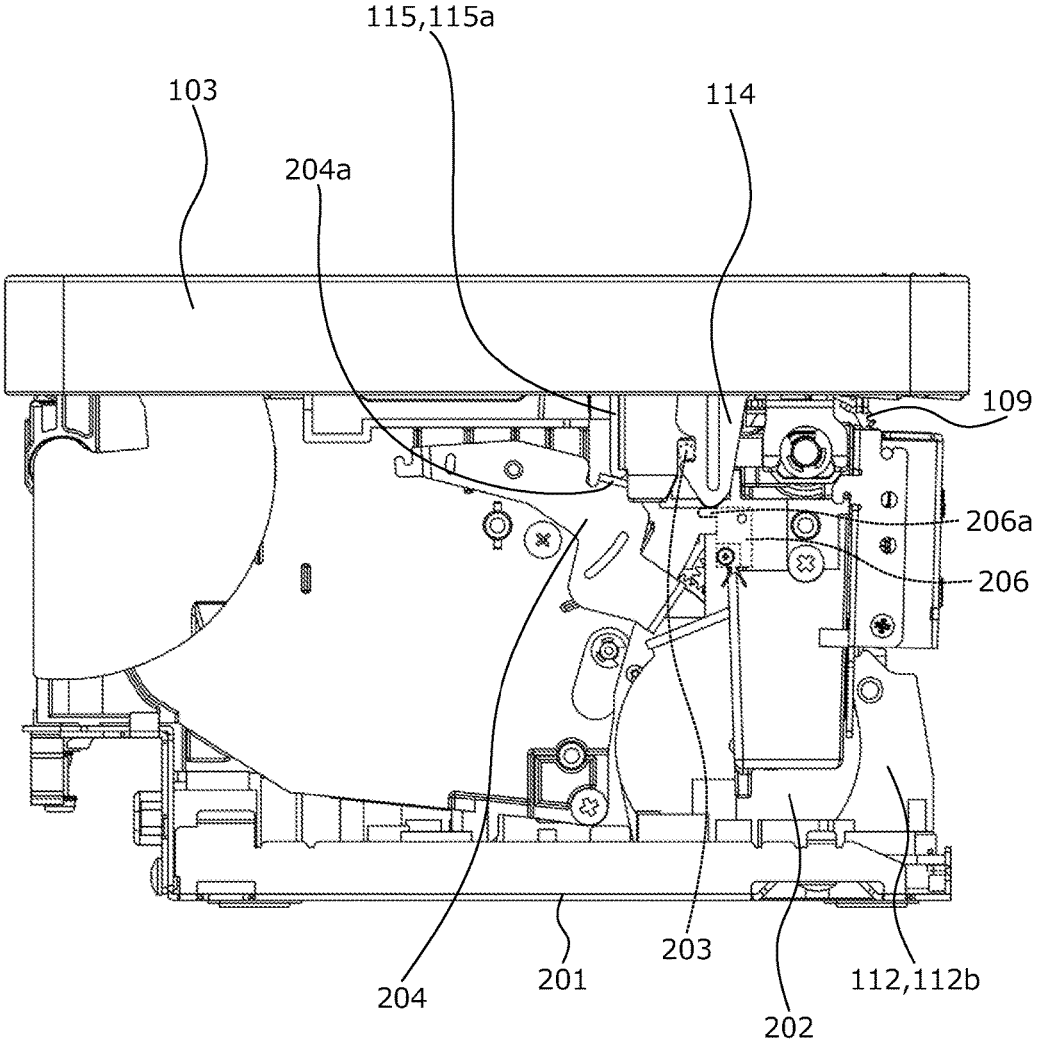
FIG. 8 is a diagram (part 3) depicting the operation of the cover opening and closing mechanism.

Operation of the cover opening and closing mechanism will be described. FIGS. 6, 7, and 8 are diagrams depicting operation of the cover opening and closing mechanism. FIGS. 6 to 8 each depicts a state where the side frame 112 (the side frame 112*b* equipped with the lock sensor 206) on the anterior side in FIGS. 3 to 5 is removed.

As depicted in FIG. 6, when the cover 103 is positioned at a position opened more than the predetermined range from the closed position, the first contact member 204 and the second contact member 115 are separated from each other and do not abut. The first contact member 204, in a state separated from the second contact member 115, is subject to a biasing force of the biasing member 205 and is thereby positioned at a standby position farthest toward the cover 103 within a range in which the first contact part 204*a* can move.

When the cover 103, which is at the open position, is positioned at the closed position, the cover 103 further rotates toward the closed position from the position depicted in FIG. 6 and as depicted in FIG. 7, the first contact members 204 and the second contact members 115 abut. Subsequently, when the cover 103 further rotates toward the closed position from the position depicted in FIG. 7, the first contact members 204 are biased by the second contact members 115, rotate in a direction to be separated from the cover 103 using the coupling position with the side frame 112 as a fulcrum, and are pushed toward a bottom side of the main body casing 102.

Here, the first contact members 204 are connected to each other and therefore, a positional relationship of the first contact parts disposed at both end sides in the width direction can be maintained to be constant. As a result, when the second contact members 115 and either of the first contact members 204 abut, the first contact member 204 that is not abutted is interlinked with the behavior of the first contact member 204 that is abutted and rotates in a direction to be separated from the cover 103 using the coupling position with the side frame 112 as a fulcrum.

Further, since second contact parts are connected to each other, a positional relationship of the second contact parts changing with rotation of the cover 103 can be maintained to be constant. The positional relationship of the first contact parts connected to each other as described above is kept constant, whereby due to the second contact parts being connected to each other, the first contact parts and the second contact parts can assuredly abut at both ends of the cover 103 in the width direction.

Further, the second contact members 115 are integrally formed by processing a sheet metal member and therefore, for example, even in an instance where the cover 103 is formed using a material such as a plastic having a low rigidity and a biasing force is applied to the cover 103 when the cover 103 is opened or closed, deformation of the cover 103 can be prevented. As a result, the cover 103 can be securely closed.

On the other hand, when the cover 103, which is at the closed position, is opened, first, the operation lever 105 is manipulated and locking by the locking mechanism is released. As described, the detector part 206*a* of the lock sensor 206 rotates to the detection position only in an instance when the lock lever 114 is at a position where the hook 114*a* and the engaging unit 203 engage.

Therefore, at the time of manipulation of the operation lever 105, the detector part 206*a* rotates to the standby position and the control circuit determines that the cover 103 is not locked, based on a signal output from the lock sensor 206. As a result, when either of the lock levers 114 disposed at both ends in the width direction is not engaged with the engaging unit 203, or the like, a state in which the cover 103 is not completely closed can be assuredly prevented from occurring.

The first contact members 204 are biased by the biasing member 205 and therefore, when locking is released, the first contact members 204, due to the biasing force of the biasing member 205, push second members in a direction rotating the cover 103 from the closed position to the open position. As a result, without the user manually rotating the cover 103 from the closed position to the open position, the cover 103 can be assuredly opened by the user merely manipulating the operation lever 105 to release the locking by the locking mechanism.

Further, the first contact members 204 are connected to each other and the positional relationship of the first contact parts disposed on both end sides in the width direction can be maintained to be constant. Therefore, at both ends in the width direction, the first contact members 204 push the second contact members 115. Further, the first contact members 204 of both ends in the width direction work in conjunction with each other and therefore, when one of the first contact members 204 is not released from a locked state and as a result, the second contact member 115 corresponding thereto cannot be pushed up, rotation of the other first contact member 204 also does not occur. As a result, a biasing force in the width direction acts on the cover 103, enabling deformation of the cover 103 to be prevented.

Further, since the second contact members 115 are connected to each other, the behavior of the second contact members 115 can be interlinked, whereby a biasing force can be prevented from acting on the cover 103 when locking of either of the second contact members 115 is not released. As a result, for example, even when the cover 103 is formed using a material such as plastic having a low rigidity, deformation of the cover 103 can be prevented.

In the described embodiment, although a configuration is described in which the first contact members 204 are capable of rotating using the coupling positions with the side frames 112 as a fulcrum, and are biased by the biasing member 205 in a direction to push the second contact members 115, the configuration is not limited hereto. The configuration may be such that the first contact members 204 are capable of motion (linear motion) along an opposing direction of the main body casing 102 and the cover 103 positioned at the closed position, and the first contact members 204 are biased by the biasing member 205 in a direction to push the second contact members 115.

Further, in the described embodiment, although a configuration is described in which the first contact members 204 are disposed in the main body casing 102, and the second contact members 115 are disposed in the cover 103, the configuration is not limited hereto. The configuration may be such that the first contact members 204 are disposed in the cover 103, and the second contact members 115 are disposed in the main body casing 102.

In the described embodiment, although the configuration is such that the first contact members 204 are biased by the biasing member 205 so as to push the second contact members 115, the configuration is not limited hereto. For example, the second contact members 115 in the described embodiment may have a biasing member that biases the second contact members 115 so as to push the first contact members 204.

In this case as well, when locking by the locking mechanism is released, due to the biasing force of the biasing member biasing the second contact members 115, the second contact members 115 push the first contact members 204, whereby the cover 103, for which the locking is released by the counterforce at this time, can be assuredly rotated in a direction to open.

Further, the biasing member is not limited to biasing either the first contact members 204 or the second contact members 115 and may be disposed for each of the first contact members 204 and the second contact members 115 so as to bias each.

As described, the cover opening and closing mechanism of the embodiment according to the present invention includes the main body casing 102 having an opening; the cover 103 coupled to the main body casing 102 so as to enable the cover 103 to rotate between the closed position closing the opening provided in the main body casing 102 and the open position opening the opening; the locking mechanism fixing the cover 103 at the closed position in a releasable manner; and the pop-up mechanism that rotates the cover 103 from the closed position toward the open position, when the fixed state by the locking mechanism is released.

The pop-up mechanism includes the first contact members 204 that are connected to each other and respectively disposed at both ends of the main body casing 102, the ends in a direction parallel to the rotation axis of the cover 103; the second contact members 115 that are disposed, respectively, at positions where a trace of movement accompanying rotation of the cover 103 interferes with the first contact member 204, the second contact members 115 abutting the first contact members 204 when the cover 103 is positioned within the predetermined range from the closed position; and the biasing member 205 that biases the first contact members 204 in a direction so that the first contact members 204 push the second contact members 115.

According to the cover opening and closing mechanism of the embodiment according to the present invention, the first contact members 204 are connected to each other and therefore, a positional relationship of the first contact members 204 can be maintained to be constant. As a result, when either of the first contact members 204 is abutted by the second contact members 115, the other first contact member 204 can be interlinked to the behavior of the abutted first contact member 204 and a force that rotates the cover 103 toward the open position can be assuredly applied to both ends of the cover 103 in the width direction.

As a result, even when the cover 103, which is formed using a material such as a plastic having low rigidity, is opened or closed and a biasing force is applied to the cover 103, deformation of the cover 103 is prevented and the cover 103 can be assuredly opened or closed.

According to the cover opening and closing mechanism of the embodiment according to the present invention, the second contact members 115 are pushed by the first contact members 204 due to the biasing force of the biasing member 205, whereby when a fixed state of the cover 103 established by the locking mechanism is released, the cover 103 can be rotated from the closed position toward the open position.

Here, since the first contact members 204 are connected to each other, the behavior of one of the first contact members 204 and the behavior of the other first contact member 204 can be interlinked, enabling a biasing force that rotates the cover 103 toward the opening position to be applied to the cover 103, at both ends of the cover 103 in the width direction. As a result, the cover 103 can be assuredly opened by merely releasing the fixed state established by the locking mechanism.

Further, according to the cover opening and closing mechanism of the embodiment according to the present invention, since the biasing member 205 is disposed, when the cover 103 is closed, the cover 103 has to be pushed toward the main body casing 102, against the biasing force of the biasing member 205 until the cover 103 is locked by the locking mechanism. As a result, the cover 103 can be securely closed.

Further, the cover opening and closing mechanism of the embodiment according to the present invention has a feature in that the first contact members 204 are integrally formed by processing of a sheet metal member. According to the cover opening and closing mechanism of the embodiment according to the present invention, the first contact members 204 disposed at both ends of the cover 103 in the width direction are integrally formed by sheet metal processing, whereby the number of parts and the number of manufacturing processes can be suppressed.

Further, the cover opening and closing mechanism of the embodiment according to the present invention has a feature in that the second contact members 115 are connected to each other. According to the cover opening and closing mechanism of the embodiment according to the present invention, since the second contact members 115 are connected to each other, the positional relationship of the second contact members 115 can be maintained to be constant. As a result, at both ends of the cover 103 in the width direction, the first contact member 204 and the second contact member 115 can be made to assuredly abut.

Further, as a result, even when the cover 103, which is formed using a material such as a plastic having a low rigidity, is opened or closed and a biasing force is applied to the cover 103, deformation of the cover 103 is prevented and the cover 103 can be assuredly opened or closed.

The cover opening and closing mechanism of the embodiment according to the present invention has a feature in that the second contact members 115 are integrally formed by processing a sheet metal member. According to the cover opening and closing mechanism of the embodiment according to the present invention, the second contact members 115 disposed at both ends of the cover 103 in the width direction are integrally formed by metal sheeting processing, whereby the number of parts and the number of manufacturing processes can be suppressed.

Further, the cover opening and closing mechanism of the embodiment according to the present invention has a feature in that the locking mechanism includes the lock levers 114 respectively disposed at ends of the cover 103 in the width direction, the lock levers 114 being equipped with the hook 114*a* at an end protruding toward the other one of the main body casings 102; and the engaging units 203 that are disposed in the main body casing 102 and engage with the hooks 114*a* in a state where the cover 103 is positioned at the closed position. The cover opening and closing mechanism of the embodiment according to the present invention has a further feature in that at least one of the lock levers 114 is equipped with the lock sensor 206 that detects that the hook 114*a* and the engaging unit 203 are positioned at an engaging position.

According to the cover opening and closing mechanism of the embodiment according to the present invention, since the cover 103 can be securely closed as described, positioning of the cover 103 at the closed position can be detected with accuracy by merely detecting the position of at least one of the lock levers 114. As a result, the number of parts and the number of manufacturing processes can be suppressed.

Further, according to the cover opening and closing mechanism of the embodiment according to the present invention, by detecting the position of the lock lever 114 and not the position of the cover 103, positioning of the cover 103 at the closed position can be detected accurately.

The printer 100 of the embodiment according to the present invention has a feature in that the printer 100 includes the printer main body that includes the housing unit 106 that houses the recording medium, and the recording unit that performs a recording operation with respect to the recording medium; the main body casing 102 that houses the printer main body and has an opening that opens the housing unit 106 to the outside; the cover 103 that is coupled to the main body casing 102 so as to enable the cover 103 to rotate, the cover 103 rotating to be positioned at the closed position closing the opening or at the open position opening the opening; and the cover opening and closing mechanism described above.

According to the printer 100 of the embodiment according to the present invention, even when a biasing force is applied to the cover 103 when the cover 103, which is positioned at the open position, is positioned at the closed position when the recording medium is replaced or the like, deformation of the cover 103 is prevented and the cover 103 can be assuredly opened or closed. As a result, hindered conveyance of the recording medium due to the cover 103 not being securely closed and decreases in recording quality can be prevented, enabling recording quality to be assured.

According to the cover opening and closing mechanism and the printer of the present invention, an effect is achieved in that deformation of the cover is prevented and the cover can be assuredly opened or closed.

As described, the cover opening and closing mechanism and printer according to the present invention are useful for a printer and a cover opening and closing mechanism related to opening and closing a cover coupled to a main body casing. The cover opening and closing mechanism and printer according to the present invention are particularly suitable for a printer and a cover opening and closing mechanism having a pop-up mechanism that pushes up the cover coupled in a rotatable manner.

What is claimed is:

1. A cover opening and closing mechanism comprising:

a main body casing having an opening;

a cover coupled to the main body casing in a manner enabling the cover to rotate between a closed position closing the opening of the main body casing and an open position opening the opening;

a locking mechanism that fixes the cover at the closed position in a releasable manner; and a pop-up mechanism that rotates the cover from the closed position toward the open position when locking by the locking mechanism is released, wherein the pop-up mechanism includes:

a first contact member having first contact parts that are connected to each other and are respectively disposed at both ends of one of the main body casing and the cover, the both ends being in a direction parallel to a rotation axis of the cover;

a second contact member having second contact parts respectively disposed at another of the main body casing and the cover not disposed with the first contact parts, the second contact parts being disposed at positions that interfere on a trace of movement of the first contact parts accompanying rotation of the cover, the second contact parts abutting the first contact parts when the cover is positioned within a predetermined range from the closed position; and a biasing member that biases the first contact member in a direction so that the first contact parts push the second contact parts.

2. The cover opening and closing mechanism according to claim 1, wherein the first contact member is integrally formed by processing of a sheet metal member.

3. The cover opening and closing mechanism according to claim 1, wherein the second contact parts are connected to each other.

4. The cover opening and closing mechanism according to claim 1, wherein the second contact member is integrally formed by processing of a sheet metal member.

5. The cover opening and closing mechanism according to claim 1, wherein the locking mechanism further includes:

lock levers respectively disposed at both ends of one of the cover and the main body casing, the lock levers having a hook at an end protruding toward another of the cover and the main body casing not disposed with the lock levers; and engaging members disposed at the another of the cover and the main body casing not disposed with the lock levers, the engaging members engaging with the hooks in a state where the cover is positioned at the closed position, and at least one of the lock levers includes a lock sensor that detects that the hooks and the engaging members are positioned at an engaging position.

6. A printer comprising:

a printer main body including:

a housing unit that houses a recording medium; and a recording unit that performs a recording operation for the recording medium;

a main body casing that houses the printer main body and has an opening that opens the housing unit to an outside;

a cover coupled to the main body casing in a manner enabling the cover to rotate, whereby the cover is positioned at a closed position closing the opening and an open position opening the opening; and the cover opening and closing mechanism according to claim 1.

7. The cover opening and closing mechanism according to claim 1, wherein the biasing member is a member other than a member that connects the first contact parts with each other.

* * * * *